US009381393B1

(12) United States Patent
Gonzalez

(10) Patent No.: US 9,381,393 B1
(45) Date of Patent: Jul. 5, 2016

(54) SUSPENDED WEIGHT BARBELL ATTACHMENT

(71) Applicant: Daniel Mathew Gonzalez, Miami, FL (US)

(72) Inventor: Daniel Mathew Gonzalez, Miami, FL (US)

( * ) Notice: Subject to any disclaimer, the term of this patent is extended or adjusted under 35 U.S.C. 154(b) by 96 days.

(21) Appl. No.: 14/477,155

(22) Filed: Sep. 4, 2014

(51) Int. Cl.
*A63B 21/078* (2006.01)
*A63B 21/072* (2006.01)

(52) U.S. Cl.
CPC ..... *A63B 21/078* (2013.01); *A63B 21/072* (2013.01)

(58) Field of Classification Search
CPC ..... A63B 21/078; A63B 21/0783; A63B 21/0724; A63B 21/072; A63B 21/0728; A63B 21/4029; A63B 2023/0411; A63B 21/062; A63B 21/4035; A63B 2208/0204; A63B 2071/0081; A63B 2220/13; A63B 21/0624; A63B 21/0632
USPC ..... 482/104, 92–94, 97–98, 101, 110
See application file for complete search history.

(56) References Cited

U.S. PATENT DOCUMENTS 4,890,831 A 1/1990 Craig
4,934,693 A * 6/1990 Santoro ..... A63B 21/0626 482/104
5,029,849 A 7/1991 Nurkowski
5,257,964 A 11/1993 Petters
5,468,203 A 11/1995 Okonkwo
5,669,859 A 9/1997 Liggett
2,321,022 A 7/1998 Robert
5,984,843 A 11/1999 Morton
6,623,409 B1 9/2003 Abelbeck
6,632,159 B1 * 10/2003 Slattery ..... A63B 21/078 482/4
6,702,723 B2 3/2004 Landfair
6,746,379 B1 6/2004 Brawner
7,488,277 B1 * 2/2009 Knapp ..... A63B 21/078 482/104
D590,032 S * 4/2009 Webber ..... D21/673
7,520,843 B1 * 4/2009 Goddard ..... A63B 21/0724 482/104
7,549,950 B1 * 6/2009 Lundquist ..... A63B 21/078 482/101
7,641,602 B2 * 1/2010 Rogers ..... A63B 21/0615 482/100
7,753,830 B1 * 7/2010 Marsh ..... A63B 21/078 482/104
7,815,555 B2 * 10/2010 Webber ..... A63B 21/0618 482/104

(Continued)

*Primary Examiner* — Oren Ginsberg
*Assistant Examiner* — Andrew S Lo
(74) *Attorney, Agent, or Firm* — Albert Bordas, P.A.

(57) ABSTRACT

A suspended weight barbell attachment apparatus, having a barbell assembly with first and second distal ends. Further having two actuating assemblies, each with a housing assembly having an interior wall, an exterior wall, and a hole that extends from the interior wall to the exterior wall. The housing assembly further has a reinforced section. The hole has a cooperative shape and dimension to house a respective reinforced section therethrough. Each reinforced section receives a respective first or second distal end. Each of the two actuating assemblies further has a handle assembly, and a locking assembly. Further having two post assemblies, each with vertical walls, a top end, and a bottom end. The vertical walls have a plurality of notches. Each housing assembly is slidably positioned between the vertical walls of a respective post assembly. And further having two base frame assemblies.

16 Claims, 6 Drawing Sheets

(56) References Cited

U.S. PATENT DOCUMENTS

| | | | | |
|---|---|---|---|---|
| 7,878,958 | B2 * | 2/2011 | Hockemeyer | A63B 21/078 482/142 |
| 8,047,972 | B1 * | 11/2011 | Dean | A63B 1/005 482/101 |
| D650,022 | S * | 12/2011 | Lundquist | D21/673 |
| 8,231,509 | B2 * | 7/2012 | Lundquist | A63B 21/075 482/94 |
| 8,328,698 | B1 * | 12/2012 | Webber | A63B 21/078 482/104 |
| 8,500,608 | B1 * | 8/2013 | Bonomi | A63B 21/062 482/101 |
| 9,028,377 | B2 * | 5/2015 | Hood | A63B 21/023 482/108 |
| 2006/0166794 | A1 | 7/2006 | Brown | |
| 2006/0252609 | A1 * | 11/2006 | Abelbeck | A63B 21/078 482/92 |
| 2007/0042876 | A1 * | 2/2007 | Lundquist | A63B 21/0783 482/94 |
| 2011/0092344 | A1 | 4/2011 | Parrilla | |

* cited by examiner

SUSPENDED WEIGHT BARBELL ATTACHMENT

BACKGROUND OF THE INVENTION

1. Field of the Invention

The present invention relates to weightlifting equipment, and more particularly, to weightlifting barbell attachment devices.

2. Description of the Related Art

Applicant believes that one of the closest references corresponds to U.S. Patent Application Publication No. 20110092344 A1, published on Apr. 21, 2011 to Marco Parrilla for Barbell Holder. However, it differs from the present invention because Parrilla teaches a weightlifting barbell holder assembly for mounting a weightlifting barbell in a generally horizontal position on a horizontal metal beam, typically an I-beam or U-beam. The barbell is at least partially within a horizontal channel defined by the beam when mounted thereon.

Applicant believes that another reference corresponds to U.S. Patent Application Publication No. 20060166794 A1, published on Jul. 27, 2006 to Harold R. Brown for Arrangement Including Weight-Supporting Device. However, it differs from the present invention because Brown teaches a weight-supporting arrangement that includes a weight-supporting device having a vertical support member including a top end and a bottom end, a base arrangement disposed at the bottom end of the vertical support member when the device is in an operating position, and a connector disposed at the top end of the vertical support member when the device is in an operating position, the connector being adapted to be connected to a weight.

Applicant believes that another reference corresponds to U.S. Pat. No. 6,746,379 B1 issued to William Matthews Brawner on Jun. 8, 2004 for Self-Spotting Safety Bench Press. However, it differs from the present invention because Brawner teaches a self-spotting safety bench press composed of an adjustable bench and uprights located on either side of the bench adjacent the lifters upper body. Lifting arms extend from the uprights into the barbells pathway and have the ability to slide up and down to contact the barbell and decrease the weight exerted on the exerciser. Hydraulic cylinders provide force to each lifting arm, which is depressed below the barbells path before use. When assistance is needed, the exerciser releases a hydraulic restrictor valve causing the arms to ascend removing a user-determined amount of weight from the barbell while permitting the user to continue performing repetitions. A second restrictor valve can allow only upward movement should the exerciser fail. A third flow restrictor valve adjusts the rate of arm travel. An air charged hydraulic accumulator provides the hydraulic pressure to the cylinders.

Applicant believes that another reference corresponds to U.S. Pat. No. 6,702,723 B2 issued to Craig D. Landfair on Mar. 9, 2004 for Weightlifting Plate. However, it differs from the present invention because Landfair teaches a weight plate having rotatable handles. By rotating, the handles provide a grip to the user, while allowing the user to perform various exercises without adjusting his or her grip on the device. The handles also facilitate the loading and unloading of the device on plate-loaded exercise equipment. The weight plate may thus be used as a stand-alone exercise device, as a weight plate loaded onto a barbell or dumbbell bar, or as a weight plate used on plate-loaded exercise equipment.

Applicant believes that another reference corresponds to U.S. Pat. No. 6,623,409 B1 issued to Kevin G. Abelbeck on Sep. 23, 2003 for Automatic Locking Exercise Device and Method. However, it differs from the present invention because Abelbeck teaches an automatic locking exercise device that incorporates a one-way locking mechanism. The device includes a frame, which supports a track, a pair of linear bearing rods one on each side. A guide member, or linear bearing runs on each bearing rod and is attached to a handle or bar that is grasped by a user. A one-way lock is used to provide movement of the bar along the track in an upward direction but opposes movement down. Rotating the bar actuates a lock release. This disengages the one-way lock and enables the bar to move freely up and down along the track. If the user ever drops the weight the one-way lock automatically engages and catches the weight. The weight will be automatically caught at its highest point without risk of injuring someone. Marking the highest point allows the user to quantify their training performance and progress.

Applicant believes that another reference corresponds to U.S. Pat. No. 5,984,843 A issued to Lee Robert Morton on Nov. 16, 1999 for Free Standing Safety Barbell. However, it differs from the present invention because Morton teaches an exercise apparatus for use in performing physical exercises with weights, which exercise apparatus includes first weight-receiving means having a base and an upstanding member for receiving weights, second weight-receiving means including a base and an upstanding member for receiving weights, and a bar which is releaseably connectable to the first and the second weight-receiving means, whereby the first and the second weight-receiving means are positioned one at each end of the bar so that a person performing the different physical exercises is able to hold the bar between the first and the second weight-receiving means.

Applicant believes that another reference corresponds to U.S. Pat. No. 5,669,859 A issued to Mariah T. Liggett, et al. on Sep. 23, 1997 for Weightlifting Apparatus. However, it differs from the present invention because Liggett, et al. teaches a multi-exercise free weight exercise apparatus, which simulates free weight barbell exercise motions while preventing injury to a weightlifter. The weightlifting apparatus is comprised of a weight bar, which rides on horizontal and vertical guide tracks and contains a safety catch mechanism device which latches onto pins located on upright brace supports should the weightlifter be unable to complete an exercise. The apparatus will allow a lifter to perform sophisticated exercises such as squatlifts, bench presses, deadlifts, and military presses in a natural free weight exercise motion while having the safety features of a non-free weight machine.

Applicant believes that another reference corresponds to U.S. Pat. No. 5,468,203 A issued to Charles U. Okonkwo on Nov. 21, 1995 for Weight Lifting Safety Device. However, it differs from the present invention because Okonkwo teaches a safety device for weight lifters having a pair of stands attachable at a collar at opposite ends of a barbell. The stands have telescopic members releasable in the event a lifter is in trouble. The stands descend to the surface to stabilize the barbell and remove the weight from the lifter. The release is controlled by a switch or tilt sensor, which activates a solenoid operator. Stops are provided to limit the relative travel of the telescopic members.

Applicant believes that another reference corresponds to U.S. Pat. No. 5,257,964 A issued to Oliver Petters on Nov. 2, 1993 for Barbell For Use In Weight Training. However, it differs from the present invention because Petters teaches a barbell consisting of two elongate vertical members extending substantially vertically from base supports. A substantially horizontal member is secured between the vertical members. Weights are removably secured to the vertical members adjacent to the base supports.

Applicant believes that another reference corresponds to U.S. Pat. No. 5,029,849 A issued to Paul S. Nurkowski on Jul. 9, 1991 for Varying Resistance Weightlifting Apparatus. However, it differs from the present invention because Nurkowski teaches an apparatus for weight training attached to a weightlifting device, such as a barbell or a selectorized weightlifting device. A second weight to be lifted is then coupled to the apparatus. The apparatus is adjusted for the varying skeletal configurations of various individual users. Within one portion of the exercise stroke, the resistance to lifting continuously varies between that of the weight lifting device and the sum of the weightlifting device and second weight. Thus, the effect of the lifting stroke is increased for each exercise stroke.

Applicant believes that another reference corresponds to U.S. Pat. No. 4,890,831 A issued to Richard D. Craig on Jan. 2, 1990 for Barbell Exercising Device. However, it differs from the present invention because Craig teaches an exercising device for a barbell which increases the weight of the barbell during a first eccentric movement and decreases the total weight of the barbell during concentric movement. The exercising device includes a vertically elongated stand having a flat base at its lower end and a hook at its upper end. The hook is pivotal between a first position in which the hook extends around and attaches the stand to end of the barbell, and a second position in which the hook pivots away from the barbell and detaches the stand from the barbell. A weight urges the hook towards its second position so that the hook automatically moves to its second position when the base engages the ground surface. Weights are selectively added to the base to increase the overall weight of the barbell during eccentric movement as desired.

Applicant believes that another reference corresponds to GB Patent No. 2321022 A issued to Morton Lee Robert on Jul. 15, 1998 for Exercise Apparatus. However, it differs from the present invention because Morton teaches an exercise apparatus that comprises first and second weight-receiving means comprising a base and an upstanding member for receiving weights, first and second extension means, which are releasably connectable to the weight-receiving means and a bar, which is releasably connectable either to the weight-receiving means directly or to the extension means. The extension means allows for easy and safe adjustment of the resting height of the crossbar.

Other patents describing the closest subject matter provide for a number of more or less complicated features that fail to solve the problem in an efficient and economical way. None of these patents suggest the novel features of the present invention.

SUMMARY OF THE INVENTION

The present invention is a suspended weight barbell attachment apparatus, comprising a barbell assembly having first and second distal ends. Further comprising two actuating assemblies, each having a housing assembly with an interior wall, an exterior wall, and a hole that extends from the interior wall to the exterior wall. The housing assembly further has a reinforced section. The hole has a cooperative shape and dimension to receive a respective reinforced section therethrough. Each reinforced section receives a respective first or second distal end. Each of the two actuating assemblies further has a handle assembly, and a locking assembly. Further comprising two post assemblies, each having vertical walls, a top end, and a bottom end. The vertical walls have a plurality of notches. Each housing assembly is slidably positioned between the vertical walls of a respective post assembly. And further comprising two base frame assemblies.

The two base frame assemblies receives weights and/or weight plates thereon. The plurality of notches are spaced apart from each other and align with respective other plurality of notches on other of the vertical walls.

The handle assembly comprises a handle having a pivoting support and an actuating extension. Extending from the actuating extension are actuating cables that connect to locking members. The handle assembly further comprises springs that have a spring force on the locking members, causing them to protrude outwardly through the plurality of notches. When actuated, the handle causes its respective actuating extension, and consequently actuating cables, to retract the locking members from a protruding outwardly position through the plurality of notches. Thus, allowing the barbell assembly to move vertically within the two post assemblies unobstructedly when each the locking assembly is in an unlocked position.

The locking assembly comprises a handle having a locking end. In a locked position, the locking assembly is a safety lock to prevent the barbell assembly from falling vertically within the two post assemblies, whereby the handle rotates until the plurality of notches receives a respective locking end. The locking members, protruding outwardly through the plurality of notches, prevent the barbell assembly from shifting vertically upward within the two post assemblies. The locking assembly prevents the barbell assembly from falling vertically downward within the two post assemblies when the plurality of notches receives a respective the locking end.

The housing assembly further comprises a top wall, and the handle assembly is mounted thereon. The housing assembly further comprises a bottom wall, and the locking assembly is mounted thereon. The actuating cables extend from the actuating extension and connect to the locking members through a first aperture of the housing assembly. The actuating cables extend from the actuating extension and connect to the locking members through second and third apertures of the housing assembly.

Defined at the hole is a bead that creates friction with the reinforced sections. Each of the two base frame assemblies comprises at least one mounting post to receive weights and/or weight plates thereon.

It is therefore one of the main objects of the present invention to provide suspended weight barbell attachment apparatuses that prevent weightlifting injuries.

It is another object of this invention to provide suspended weight barbell attachment apparatuses that comprise incorporated safety systems.

It is another object of this invention to provide suspended weight barbell attachment apparatuses with height-adjustment means to adjust a barbell to various heights.

It is another object of this invention to provide suspended weight barbell attachment apparatuses to accommodate different starting points for weightlifting.

It is another object of this invention to provide suspended weight barbell attachment apparatuses that can be readily assembled and disassembled without the need of any special tools.

It is another object of this invention to provide suspended weight barbell attachment apparatuses, which are of a durable and reliable construction.

It is yet another object of this invention to provide such apparatuses that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
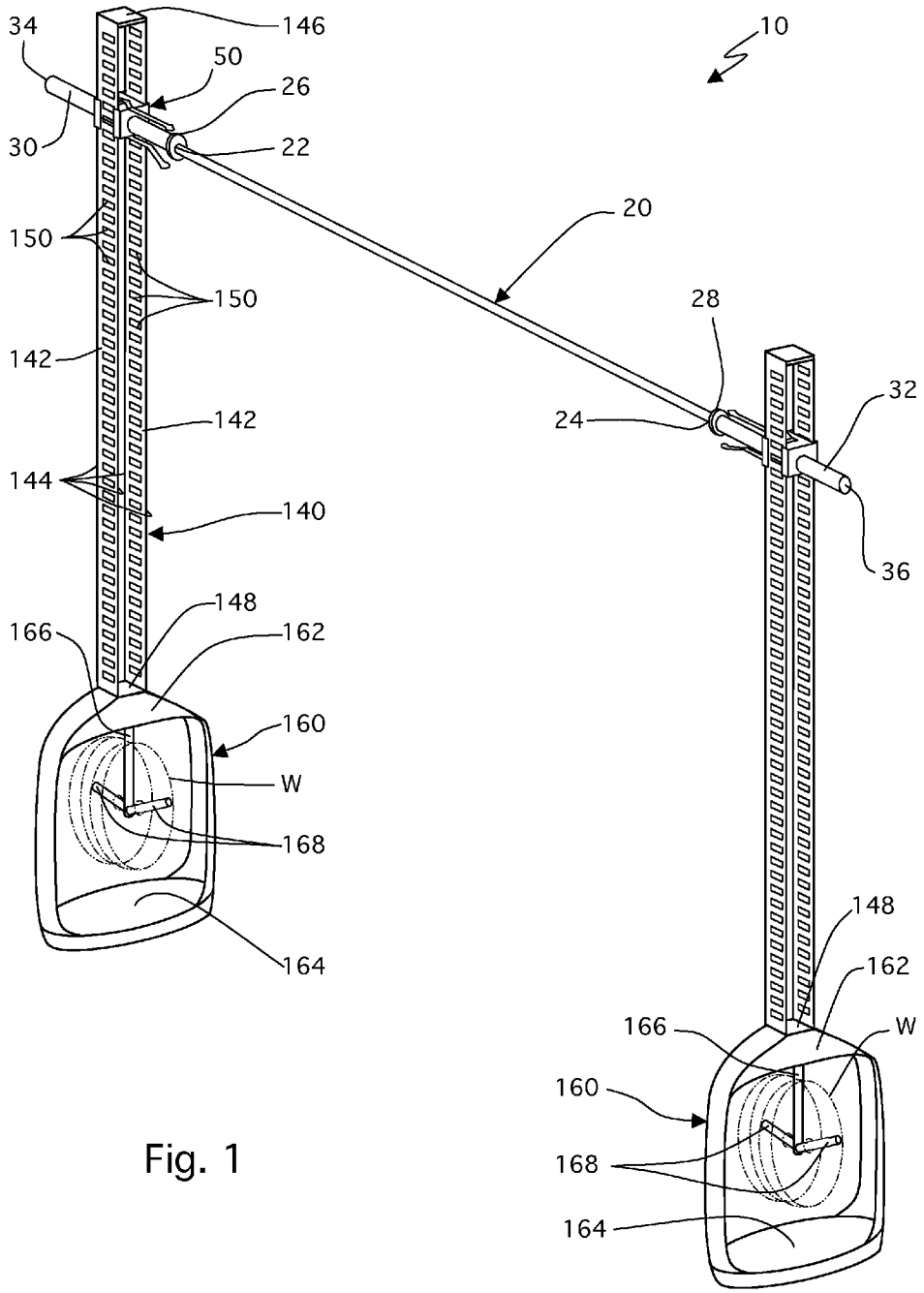
FIG. 1 represents an isometric view of the present invention.

Referring now to the drawings, the present invention is a suspended weight barbell attachment apparatus and is generally referred to with numeral 10. It can be observed that it basically includes barbell assembly 20, actuating assembly 50, post assembly 140, and base frame assembly 160.

As seen in FIG. 1, barbell assembly 20 comprises ends 22 and 24, and spacers 26 and 28. Barbell assembly 20 bears extra weight by mounting weights and/or weight plates W on mounting posts 168 as desired. Barbell assembly 20 is mounted to each post assembly 140 at respective actuating assemblies 50.

It is noted that some weights and/or weight plates W may have different inner diameters, whereby they are traditionally mounted onto a typical barbell assembly 20. If necessary, an adapter may be used to accommodate the inner diameters of weights and/or weight plates W to snuggly fit onto mounting posts 168 if desired.

Each post assembly 140 comprises two vertical walls 142 that are substantially parallel to each other, top end 146, and bottom end 148. Each vertical wall 142 has edges 144 and notches 150. Notches 150 are spaced apart from each other and align with respective notches 150 of its opposite vertical wall 142.

Each base frame assembly 160 is secured to its respective post assembly 140 at bottom end 148. Base frame assembly 160 comprises frame 162 and base 164. Supporting post 166 is rigidly mounted to an interior top end section of frame 162 and extends downwardly a predetermined distance without reaching base 164. Extending in opposite directions from a lower end of supporting post 166 are mounting posts 168. Mounting posts 168 extend transversally with respect to base 164, and in a preferred embodiment, are inclined slightly upwardly to easily receive weights and/or weight plates W thereon. Frame 162 is wide enough to allow for weights and/or weight plates W to be placed on and removed from mounting posts 168. In a preferred embodiment, base 164 is padded with rubber, or a rubber-like material, to protect a surface when base frame assemblies 160 rest thereon. The rubber bottom has rounded edges to allow rocking motions and to facilitate when moving.

Figure 2:
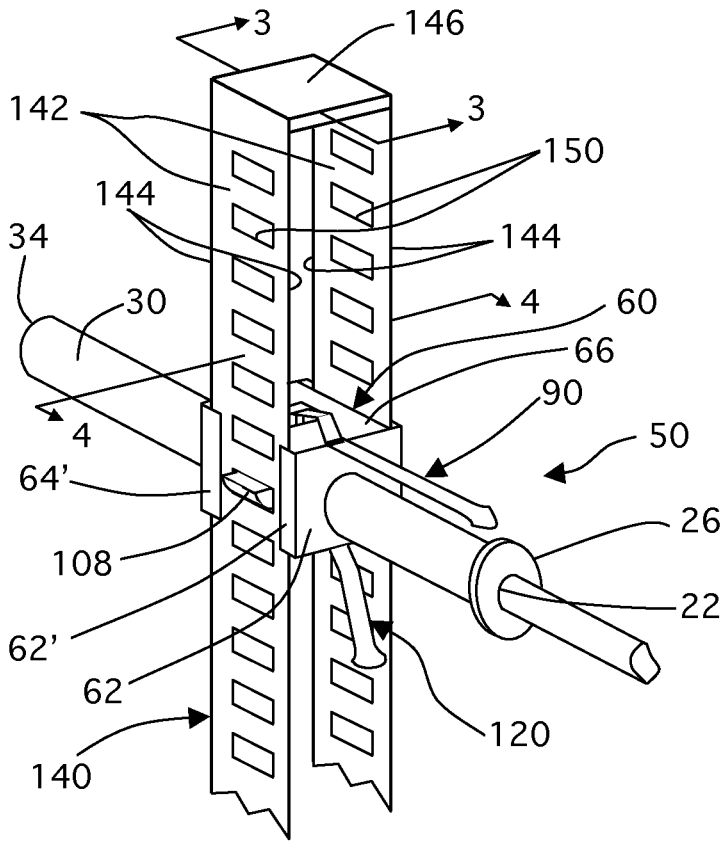
FIG. 2 is an enlarged isometric view of an actuating assembly, whereby a vertical guide assembly and barbell assembly are partially cross-sectioned.
Figure 3:
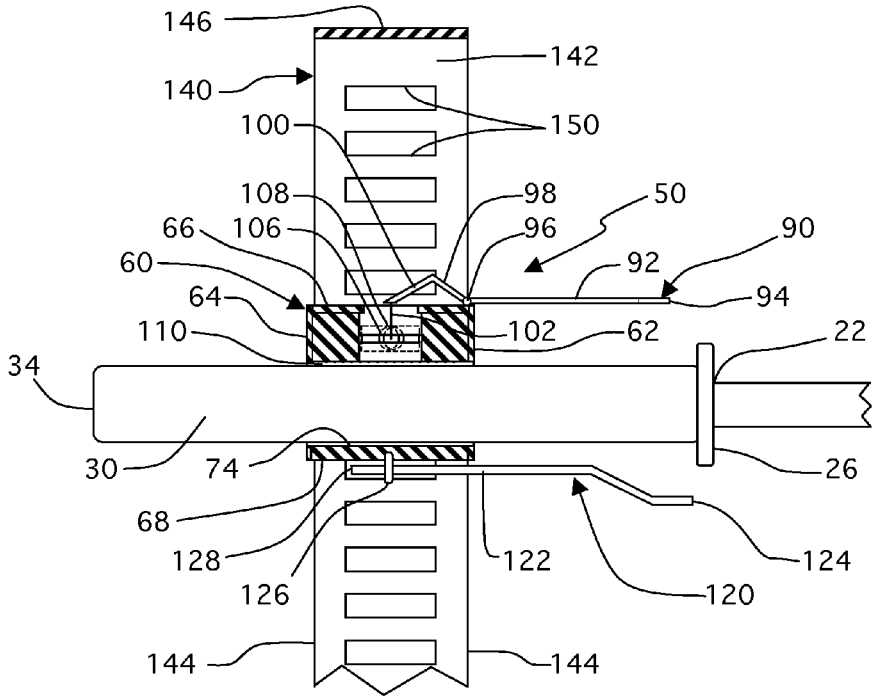
FIG. 3 is a first cross-section view taken along lines 3-3 as seen in FIG. 2, illustrating an interior section of the actuating assembly.
Figure 4:
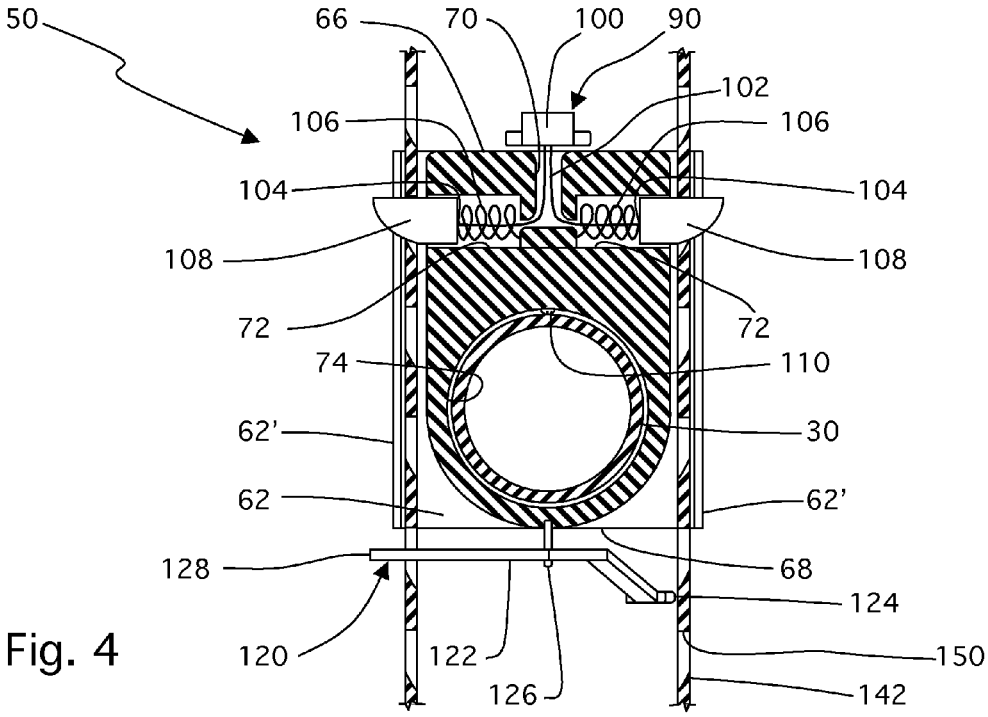
FIG. 4 is a second cross-section view taken along lines 4-4 as seen in FIG. 2, illustrating the interior section of the actuating assembly.

As seen in FIGS. 2, 3, and 4, each actuating assembly 50 comprises its respective housing assembly 60, handle assembly 90, and locking assembly 120.

Each housing assembly 60 is slidably positioned between vertical walls 142 of its respective post assembly 140. Each housing assembly 60 comprises interior wall 62, exterior wall 64, top wall 66, and bottom wall 68. Housing assembly 60 further comprises hole 74 that extends from interior wall 62 to exterior wall 64. Each housing assembly 60 further comprises reinforced sections 30 and 32 with respective distal ends 34 and 36. Hole 74 has a cooperative shape and dimension to house respective reinforced section, 30 or 32, therethrough. In addition, hole 74 has bead 110 that creates friction with reinforced sections 30 and 32 to reduce or minimize sliding therethrough. Other means to create friction with reinforced sections 30 and 32 to reduce or minimize sliding therethrough may be utilized. Interior wall 62 has lips 62', which engage first edges 144 of vertical walls 142, and exterior wall 64 has lips 64', which engage second edges 144 of vertical walls 142. Lips 62' and 64' guide housing assembly 60 when shifting vertically upward and falling vertically downward within post assemblies 140.

Each aperture 70 extends interiorly from its respective top wall 66 and connects to apertures 72. Extending from actuating extension 100 are actuating cables 102 that extend through apertures 70 and 72 and connect to locking members 108 at distal ends 104. Housed within apertures 72 are springs 106. Apertures 72 also partially house locking members 108. Springs 106 having a spring force on locking members 108, cause them to protrude outwardly through notches 150.

Handle assembly 90 is mounted to top wall 66 at pivoting support 96 and comprises handle 92 having end 94, extension 98, and actuating extension 100. Locking assembly 120 is mounted to a bottom section of housing assembly 60. Locking assembly 120 comprises handle 122 having end 124, pin 126, and locking end 128. In a preferred embodiment, a section of handle 122 is angled approximately between 20 and 70 degrees, and approximately 45 degrees is optimal. Pin 126 is fixed to bottom wall 68, and handle 122 is mounted onto and rotates upon pin 126. In a locked position, locking assembly 120 is a safety lock to prevent barbell assembly 20 from falling vertically within post assemblies 140, whereby handle 122 rotates until a notch 150 receives locking end 128.

Figure 5:
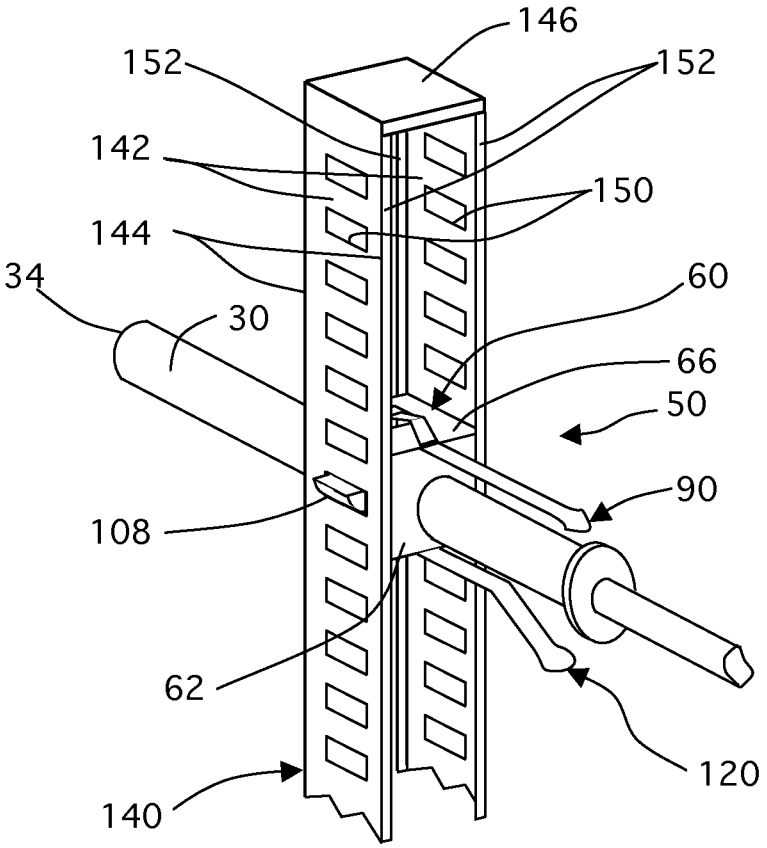
FIG. 5 is an enlarged isometric view of an alternate embodiment actuating assembly, whereby a vertical guide assembly and barbell assembly are partially cross-sectioned.

As seen in FIG. 5, interior wall 62 and a respective exterior wall, not seen, of alternate housing assembly 60 do not have lips 62' and 64' as seen in FIG. 2. Instead, vertical walls 142 have lips 152 extending from edges 144. Lips 152 guide housing assembly 60 when shifting vertically upward and falling vertically downward within post assemblies 140.

Figure 6:
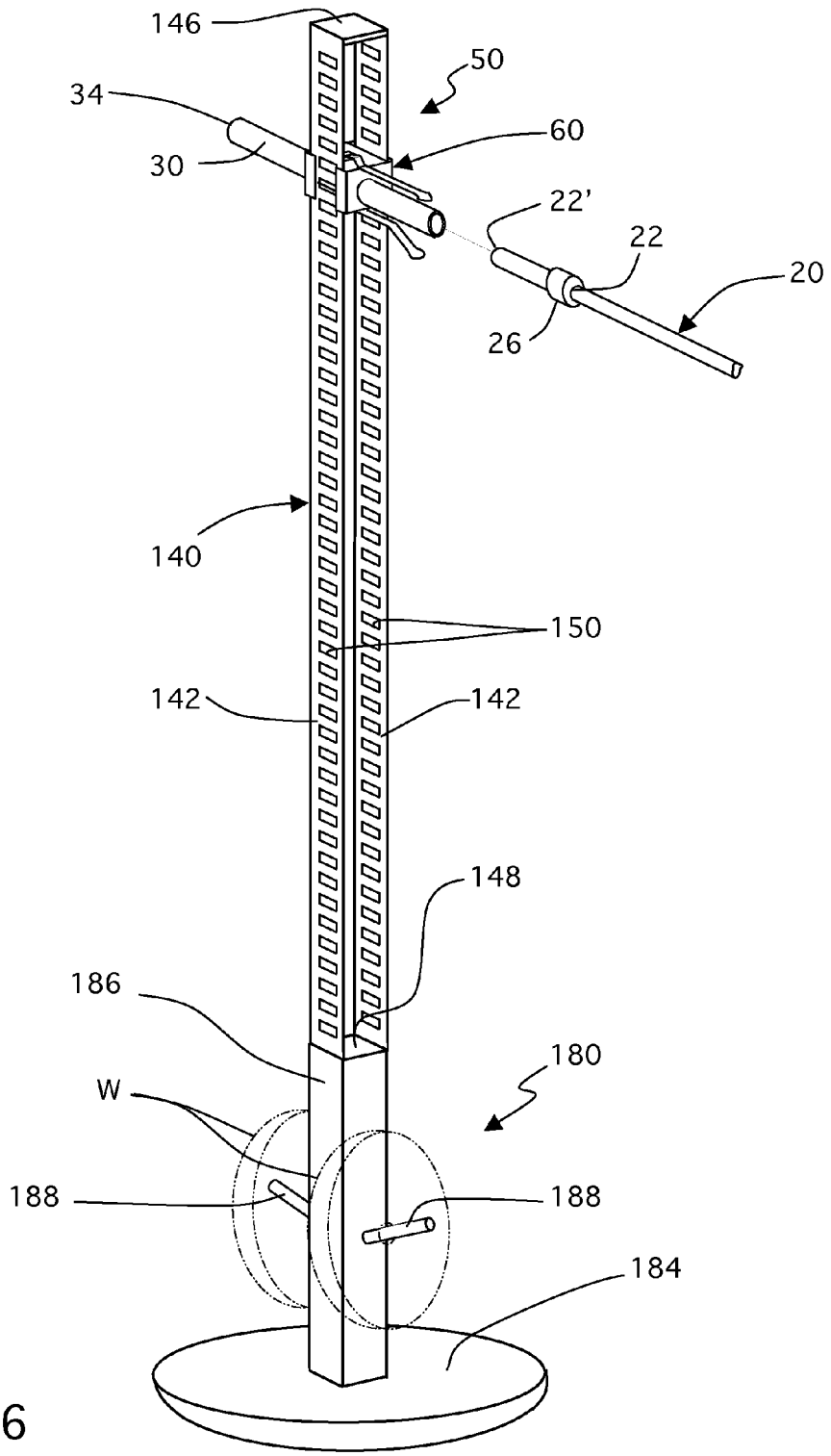
FIG. 6 represents an isometric view of a first alternate embodiment of the present invention.
Figure 7:
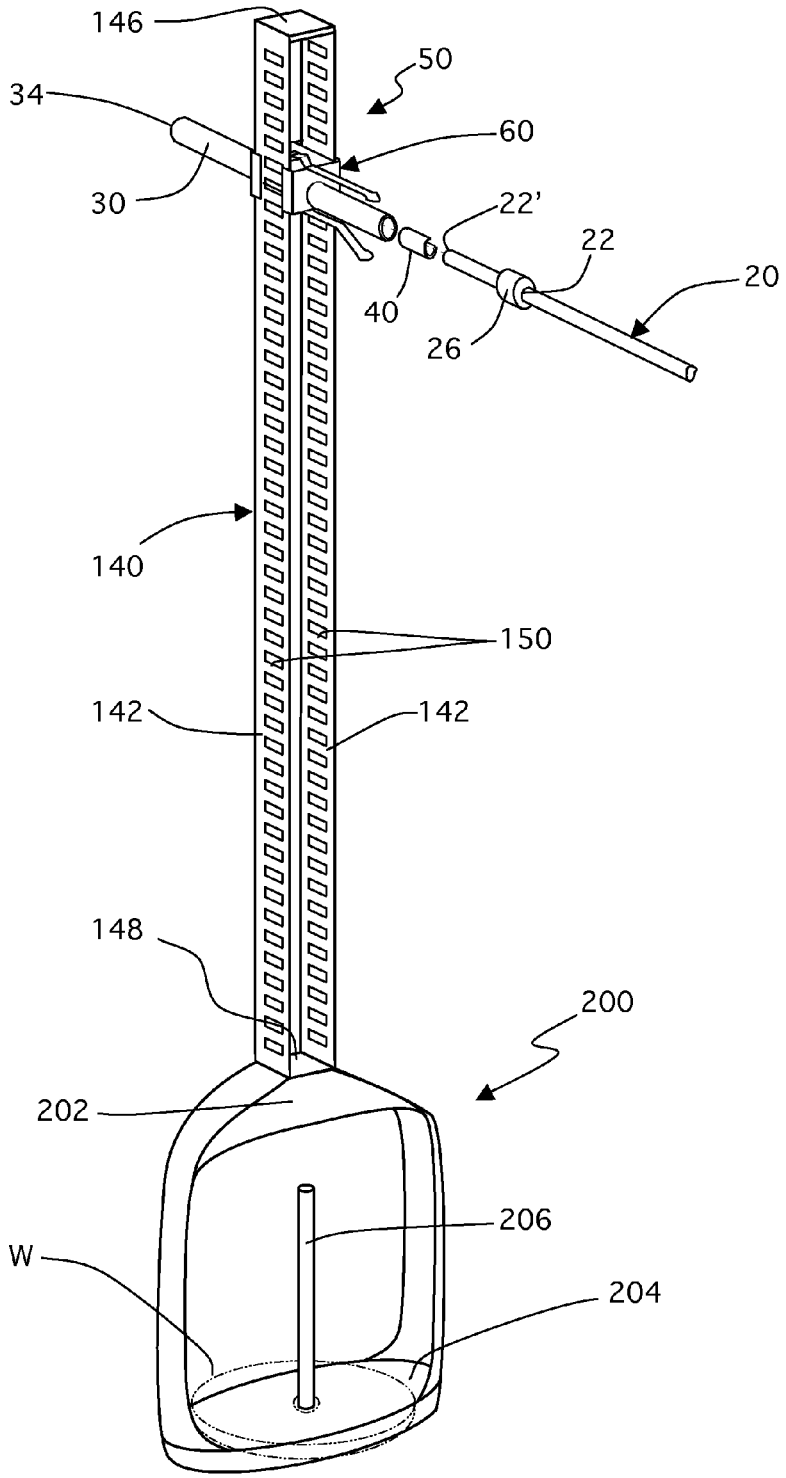
FIG. 7 represents an isometric view of a second alternate embodiment of the present invention.

As best seen in FIGS. 6 and 7, when assembling present invention 10 to perform exercise, reinforced section 30 receives either distal end of barbell assembly 20. For illustrative purposes, reinforced section 30 is shown receiving distal end 22'. Although not illustrated, it is noted that reinforced section 32 receives the other distal end of barbell assembly 20 to complete the configuration as seen in FIG. 1. In a preferred embodiment, interior cavities of reinforced sections 30 and 32 are coated with a high-friction material to prevent any movement/sliding of barbell assembly 20 when exercising or otherwise moving barbell assembly 20.

FIG. 6 illustrates a first alternate embodiment for base frame assembly 160. Each base frame assembly 180 is secured to its respective post assembly 140 at bottom end 148. Base frame assembly 180 comprises base 184. Supporting post 186 extends downwardly to base 184. Extending in opposite directions from supporting post 186 are mounting posts 188. Mounting posts 188 extend transversally with respect to base 184, and in a preferred embodiment, are inclined slightly upwardly to easily receive weights and/or weight plates W thereon. In a preferred embodiment, base 184 is padded with rubber, or a rubber-like material, to protect a surface when base frame assemblies 180 rest thereon. The rubber bottom has rounded edges to allow rocking motions and to facilitate when moving.

It is noted that some weights and/or weight plates W may have different inner diameters, whereby they are traditionally mounted onto a typical barbell assembly 20. If necessary, an adapter may be used to accommodate the inner diameters of weights and/or weight plates W to snuggly fit onto mounting posts 188 if desired.

FIG. 7 illustrates a second alternate embodiment for base frame assembly 160. Each base frame assembly 200 is secured to its respective post assembly 140 at bottom end 148. Base frame assembly 200 comprises frame 202 and base 204. Supporting post 206 is rigidly mounted onto base 204 and extends upwardly a predetermined distance without reaching an interior top end section of frame 202. Supporting post 206 receives weights and/or weight plates W thereon. Frame 202 is wide enough to allow for weights and/or weight plates W to be placed on and removed from supporting post 206. In a preferred embodiment, base 204 is padded with rubber, or a rubber-like material, to protect a surface when base frame assemblies 200 rest thereon. The rubber bottom has rounded edges to allow rocking motions and to facilitate when moving.

It is noted that some weights and/or weight plates W may have different inner diameters, whereby they are traditionally mounted onto a typical barbell assembly 20. If necessary, an adapter may be used to accommodate the inner diameters of weights and/or weight plates W to snuggly fit onto mounting post 206 if desired. In addition, adapter 40 may optionally be utilized within reinforced sections 30 and 32 to accommodate different barbell assemblies 20 of various circumferences.

In operation, each handle 92 is actuated to cause its actuating extension 100, and consequently actuating cables 102, to retract locking members 108 from a protruding outwardly position through notches 150 and into apertures 72, thus allowing barbell assembly 20 to move vertically within post assemblies 140 unobstructedly. It is noted that both locking assemblies 120 would be placed in an unlocked position, whereby each handle 122 is rotated until each locking end 128 is no longer obstructed by a respective notch 150. Once a desired height is obtained, handles 92 are released to cause locking members 108 to again protrude outwardly through notches 150 by the spring force of springs 106. And both locking assemblies 120 are again placed into the locked position to prevent barbell assembly 20 from falling vertically within post assemblies 140, whereby each handle 122 is rotated until its respective notch 150 receives its respective locking end 128. In this configuration, barbell assembly 20 is stationary. Thus, permitting a user to safely exercise by elevating present invention 10 vertically from a surface it stands upon, whereby locking members 108, protruding outwardly through notches 150, prevent barbell assembly 20 from shifting vertically upward within post assemblies 140, and locking assemblies 120 prevent barbell assembly 20 from falling vertically downward within post assemblies 140.

Present invention 10 therefore provides important functions for users/weightlifters. It allows a user/weightlifter to easily load and unload weights and/or weight plates W thereon. It serves to adjust and keep barbell assembly 20 stationary at various heights, depending on the exercise to be performed and accommodating each user/weightlifter's need to begin different exercises at different starting points. Present invention 10 also creates a lower limit stop, limiting how low barbell assembly 20 will travel before being relieved of the user/weightlifter's chosen added weight with weights and/or weight plates W. This serves to ensure that barbell assembly 20 bears extra weight only through any given exercise's range of motion, therefore reducing weight-lifting injuries by preventing barbell assembly 20 from landing on a user/weightlifter, whereby the base frame assemblies 160, 180, or 200 come to rest on a floor/surface.

Weightlifting exercises that may be performed with present invention 10, include but are not limited to: bench press, inclined bench press, declined bench press, military presses, shoulder presses, back squats, and front squats.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A suspended weight barbell attachment apparatus, comprising:

a barbell assembly comprising first and second distal ends;

two actuating assemblies, each of said two actuating assemblies comprising a housing assembly comprising an interior wall, an exterior wall, and a hole that extends from said interior wall to said exterior wall, each said housing assembly further comprising a reinforced section, said hole has a cooperative shape and dimension to house a respective said reinforced section therethrough, each said reinforced section receives a respective said first or second distal end, each of said two actuating assemblies further comprising a handle assembly, and a locking assembly, said handle assembly comprises a first handle having a pivoting support and an actuating extension operably coupled to a pair of locking members;

two post assemblies, each of said two post assemblies comprising a pair of opposing vertical walls, a top end, and a bottom end, said vertical walls comprise a plurality of notches, each said housing assembly is slidably positioned between said vertical walls of a respective of said two post assemblies, and wherein each first handle is configured to be actuated about the pivoting support to pivot a respective actuating extension and thereby retract said locking members through a pair of notches; and two base frame assemblies.

2. The suspended weight barbell attachment apparatus set forth in claim 1, further characterized in that each of said two base frame assemblies receives weights and/or weight plates thereon.

3. The suspended weight barbell attachment apparatus set forth in claim 1, further characterized in that said plurality of notches on one vertical wall are spaced apart from each other and align with a respective plurality of notches on the opposing vertical wall.

4. The suspended weight barbell attachment apparatus set forth in claim 1, further characterized in that extending from said actuating extension are actuating cables that connect to said locking members.

5. The suspended weight barbell attachment apparatus set forth in claim 4, further characterized in that said handle assembly further comprises springs that have a spring force on said locking members, causing said locking members to protrude outwardly through said plurality of notches.

6. The suspended weight barbell attachment apparatus set forth in claim 5, further characterized in that when actuated, said first handle causes its respective said actuating extension, and consequently said actuating cables, to retract said locking members from a protruding outwardly position through said plurality of notches, thus allowing said barbell assembly to move vertically within said two post assemblies unobstructedly when each said locking assembly is in an unlocked position.

7. The suspended weight barbell attachment apparatus set forth in claim 1, further characterized in that each of said locking assembly comprises a second handle having a locking end.

8. The suspended weight barbell attachment apparatus set forth in claim 7, further characterized in that in a locked position, said locking assembly is a safety lock to prevent said barbell assembly from falling vertically within said two post assemblies, whereby said second handle rotates until said plurality of notches receives a respective said locking end.

9. The suspended weight barbell attachment apparatus set forth in claim 4, further characterized in that said locking members, protruding outwardly through said plurality of notches, prevent said barbell assembly from shifting vertically upward within said two post assemblies.

10. The suspended weight barbell attachment apparatus set forth in claim 7, further characterized in that each said locking assembly prevents said barbell assembly from falling vertically downward within said two post assemblies when said plurality of notches receives a respective said locking end.

11. The suspended weight barbell attachment apparatus set forth in claim 1, further characterized in that said housing assembly further comprises a top wall, and said handle assembly is mounted thereon.

12. The suspended weight barbell attachment apparatus set forth in claim 1, further characterized in that said housing assembly further comprises a bottom wall, and said locking assembly is mounted thereon.

13. The suspended weight barbell attachment apparatus set forth in claim 4, further characterized in that said actuating cables extend from said actuating extension and connect to said locking members through a first aperture of said housing assembly.

14. The suspended weight barbell attachment apparatus set forth in claim 13, further characterized in that said actuating cables extend from said actuating extension and connect to said locking members through second and third apertures of said housing assembly.

15. The suspended weight barbell attachment apparatus set forth in claim 1, further characterized in that defined at said hole is a bead that creates friction with said reinforced section.

16. The suspended weight barbell attachment apparatus set forth in claim 3, further characterized in that each of said two base frame assemblies comprises at least one mounting post to receive weights and/or weight plates thereon.

* * * * *